US011821660B2

(12) United States Patent
Zimmer et al.

(10) Patent No.: US 11,821,660 B2
(45) Date of Patent: Nov. 21, 2023

(54) PORTABLE TEMPERATURE CONTROLLED STORAGE SYSTEM

(71) Applicant: University of Guelph, Guelph (CA)

(72) Inventors: Adam Zimmer, Guelph (CA); Timothy Mills, Peterborough (CA); Matthew Drummond, Belmont (CA)

(73) Assignee: University of Guelph, Guelph (CA)

( * ) Notice: Subject to any disclaimer, the term of this patent is extended or adjusted under 35 U.S.C. 154(b) by 0 days.

(21) Appl. No.: 17/715,651

(22) Filed: Apr. 7, 2022

(65) Prior Publication Data

US 2022/0325927 A1 Oct. 13, 2022

Related U.S. Application Data

(60) Provisional application No. 63/172,044, filed on Apr. 7, 2021.

(51) Int. Cl.

| | |
|---|---|
| ***F25B 21/04*** | (2006.01) |
| ***F25B 49/00*** | (2006.01) |
| ***F25D 11/00*** | (2006.01) |
| ***F25D 29/00*** | (2006.01) |
| ***A61J 1/16*** | (2023.01) |

(52) U.S. Cl.

CPC ..... *F25B 21/04* (2013.01); *A61J 1/165* (2013.01); *F25B 49/00* (2013.01); *F25D 11/003* (2013.01); *F25D 29/003* (2013.01); *F25B 2321/0211* (2013.01); *F25B 2321/0251* (2013.01); *F25B 2321/0252* (2013.01); *F25B 2700/2104* (2013.01); *F25D 2201/14* (2013.01); *F25D 2700/12* (2013.01)

(58) Field of Classification Search

CPC ..... F25B 21/00; F25B 21/02; F25B 21/04; F25B 2321/02; F25B 2321/0211; F25B 2700/2104; F25D 11/003; F25D 19/006; F25D 2201/14; F25D 2700/12; A61J 1/165

See application file for complete search history.

(56) References Cited

U.S. PATENT DOCUMENTS

| | | | | |
|---|---|---|---|---|
| 4,250,998 A * | 2/1981 | Taylor | ..... | A45C 11/20 220/592.01 |
| 2019/0323756 A1* | 10/2019 | Alexander | ..... | F25B 21/02 |
| 2020/0224964 A1* | 7/2020 | Alexander | ..... | F25D 11/003 |

OTHER PUBLICATIONS

TempArmour® Vaccine Carrier (Models VCT-4 / VCT-21), TempArmour Refrigeration, online product description, 2021, 6 pages <https://web.archive.org/web/20210304163756/https:/www.temparmourcom/vaccine_carrier>.

* cited by examiner

*Primary Examiner* — Jonathan Bradford

(74) *Attorney, Agent, or Firm* — BERESKIN & PARR LLP/S.E.N.C.R.L. s.r.l; Tonino Rosario Orsi

(57) ABSTRACT

At least one method and container are described for maintaining a target temperature within the container. The container generally includes a vacuum insulated body; a lid couplable to the vacuum insulated body; a heatsink, coupled to the lid, wherein a portion of the heatsink is positionable within the vacuum insulated body; and at least one thermoelectric cell coupled to the heatsink, wherein the at least one thermoelectric cell is operated to promote the transfer of heat between the inside of the container and the outside of the container to cool the inside of the container or to warm the inside of the container. The container may be arranged so that internal and external portions of the heatsink may be arranged in a decoupled position to reduce heat transfer therebetween.

18 Claims, 12 Drawing Sheets

ZJp1 Steady State Test
(at low end temp)

This allows gauging how much power is needed to maintain the low-end temperature. Several voltages were tested to attempt to correlate observed MaxCOP to theoretical/simulated.

ZJp1 cooldown test

Voltage was varied throughout cooldown to determine steady state heat sink temperatures at each voltage as well as to determine heat removal rate at differing voltages.

PORTABLE TEMPERATURE CONTROLLED STORAGE SYSTEM

CROSS-REFERENCE TO RELATED APPLICATION

This application claims the benefit of U.S. Provisional Patent Application No. 63/172,044 filed Apr. 7, 2021, and the entire contents of U.S. Provisional Patent Application No. 63/172,044 are hereby incorporated herein in its entirety.

FIELD

Various embodiments are described herein that generally relate to the field of refrigerated containers, and more specifically, refrigerated containers for transporting pharmaceutical compounds.

BACKGROUND

Certain materials such as, but not limited to vaccines, medication or other compositions, for example, are required to be kept at low temperatures to preserve quality. Generally, such compositions are kept in refrigerators to maintain them at the required low temperature. Materials that require refrigeration may require shipment. Maintaining low temperatures during shipping conventionally involves the use of refrigerated shipping trucks, insulated containers containing ice and or frozen gel packs, or some other method of refrigeration. However, refrigerated shipping trucks are expensive, complicated and not practically available in certain areas. In addition, insulated containers containing ice and or frozen gel packs are unable to maintain precise internal temperatures for long periods of time, which may impact the quality of the shipped compositions.

Some environments to which refrigerated materials are to be delivered to are relatively remote. For example, vaccines may be delivered to remote areas far from urban centers. If shipping is conducted using a slower method, the duration of shipping may be relatively long, requiring a refrigeration method that can maintain materials at a certain temperature range for long periods of time, while using an apparatus that is small and light.

SUMMARY OF VARIOUS EMBODIMENTS

In one broad aspect, at least one example embodiment described herein provides a container having a coupled and decoupled configuration for maintaining a target temperature within the container, wherein the container comprises: an insulated body; a lid that is releasably couplable to an upper portion of the insulated body; an exterior heatsink, coupled to the lid, the exterior heatsink having an exterior heatsink interface; an interior heatsink, positionable within the insulated body, the interior heatsink having an interior heatsink interface; and at least one thermoelectric cell; wherein in the coupled configuration, the exterior heatsink interface and interior heatsink interface are engaged such that heat may be readily conducted from the interior heatsink interface to the exterior heatsink interface or from the interior heatsink interface to the exterior heatsink interface; and wherein in the decoupled configuration, the exterior heatsink interface and the interior heatsink interface are separated by a vacuum volume to reduce any heat transfer between the interior heatsink interface and the exterior heatsink interface.

In at least one embodiment, the interior heatsink further comprises a carriage portion, wherein the carriage portion comprises a plurality of cavities.

In at least one embodiment, the cavities are shaped to receive at least one vessel.

In at least one embodiment, the at least one vessel includes a vial.

In at least one embodiment, the vial is a medical vial containing a pharmaceutical composition.

In at least one embodiment, each cavity may be filled with a thermal mass fluid.

In at least one embodiment, the container further comprises a sleeve that is disposed within the insulated body and has a reservoir for receiving a thermal mass fluid.

In at least one embodiment, the sleeve is disposed around the carriage portion.

In at least one embodiment, the interior heatsink interface and the exterior heatsink interface are both substantially planar.

In at least one embodiment, the at least one thermoelectric cell is coupled to the interior heatsink.

In at least one embodiment, the at least one thermoelectric cell is at least one Peltier cooler.

In at least one embodiment, the container further comprises an energy source, wherein the energy source is coupled to the at least one thermoelectric cell.

In at least one embodiment, the container further comprises a temperature sensor and a controller coupled to the energy source and the at least one thermoelectric cell, wherein the controller is configured to adjust energy flow from the energy source to the at least one thermoelectric cell based on an output from the temperature sensor.

In at least one embodiment, the energy source is at least one battery and/or at least one solar cell.

In at least one embodiment, the container further comprises an electrical interface that is connectable to an external power source that acts as the energy source.

In at least one embodiment, the insulated body is vacuum insulated.

In at least one embodiment, the insulated body is made using a thermally conductive material including one or more of a cast metal alloy, a machined thermally conductive material, or sheet metal.

In at least one embodiment, the container further comprises a fan that is coupled to the external heatsink and is operated to transfer additional heat away from the external heatsink when heat is being transferred out of the interior of the container to the surrounding environment.

In at least one embodiment, the container further comprises a radiator that is coupled to the external heatsink to promote additional heat transfer from the external heatsink to the surrounding environment of the container when heat is transferred out of the interior of the container to the surrounding environment.

In at least one embodiment, the container further comprises a decoupling mechanism for decoupling the exterior heatsink interface from the interior heatsink interface, wherein the decoupling mechanism is manual or automatic.

In at least one embodiment, the decoupling mechanism is geared and/or cammed.

In another aspect, in accordance with at least one embodiment, there is provided a container for transporting at least one vessel, wherein the container comprises: an insulated body; a lid couplable to the insulated body; a heatsink slidably receivable with the insulated body and releasably couplable to the lid, wherein the heatsink further comprises a carriage portion that is slidably positionable within the insulated body, wherein the carriage portion comprises a plurality of cavities that are each configured to receive at least one vessel; and at least one thermoelectric cell coupled to the heatsink, wherein the at least one thermoelectric cell is operated to promote the transfer of heat between the inside of the container and the outside of the container to cool the inside of the container or to warm the inside of the container.

In at least one embodiment, the container further comprises a thermal mass fluid that is received in the plurality of cavities.

In at least one embodiment, the container further comprises a sleeve that is disposed within the insulated body and around the carriage portion, and the sleeve includes a reservoir for receiving a thermal mass fluid.

In another aspect, in at least one embodiment described herein, there is provided a container for maintaining a target temperature within the container, wherein the container comprises: a vacuum insulated body; a lid couplable to the vacuum insulated body; a heatsink, coupled to the lid, wherein a portion of the heatsink is positionable within the vacuum insulated body; and at least one thermoelectric cell coupled to the heatsink, wherein the at least one thermoelectric cell is operated to promote the transfer of heat between the inside of the container and the outside of the container to cool the inside of the container or to warm the inside of the container.

In another aspect, in at least one embodiment described herein, there is provided a method of transporting at least one vessel using a container defined in accordance with the teachings herein, wherein the method comprises: placing the at least one vessel within the vacuum insulated body; coupling the lid to the vacuum insulated body; and activating the at least one thermoelectric cell, such that the at least one thermoelectric cell transfers heat from the inside of the container to the outside of the container or transfers heat from outside of the container to within the vacuum insulated body.

In at least one embodiment, the at least one vessel is a medical vial that includes a pharmaceutical composition.

In at least one embodiment, the method further comprises pouring a thermal mass fluid into cavities inside the vacuum insulated body.

In at least one embodiment, the method further comprises filling a sleeve that is disposed within the insulated body with a thermal mass fluid.

In at least one embodiment, when the container reaches a predetermined cooling temperature, the method further comprises deactivating the at least one thermoelectric cell and moving the lid to a decoupled configuration to prevent heat ingress into the container.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
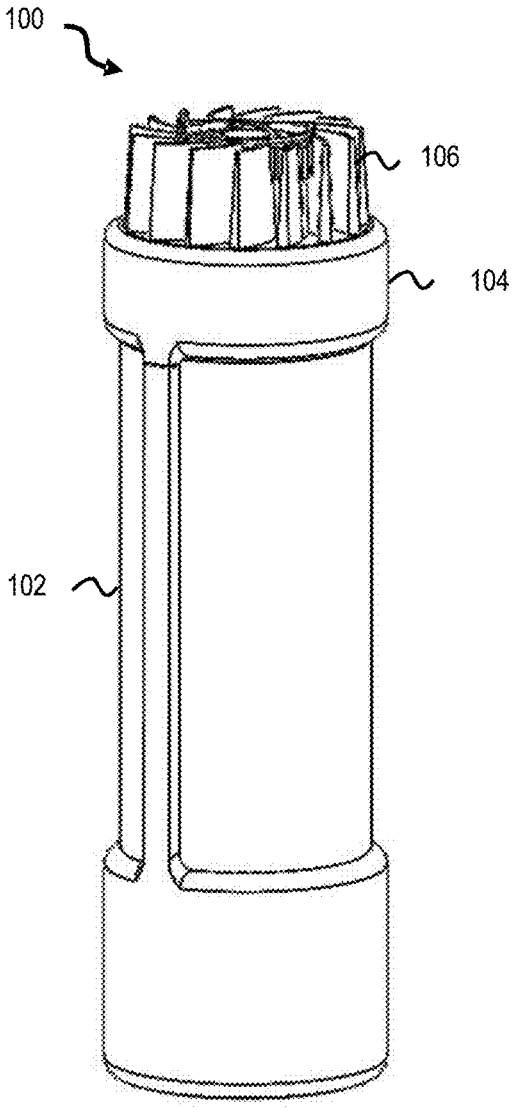
FIG. 1 is an isometric view of an example embodiment of a refrigerated container.

Further aspects and features of the example embodiments described herein will appear from the following description taken together with the accompanying drawings.

DETAILED DESCRIPTION OF THE EMBODIMENTS

Various embodiments in accordance with the teachings herein will be described below to provide an example of at least one embodiment of the claimed subject matter. No embodiment described herein limits any claimed subject matter. The claimed subject matter is not limited to devices, systems or methods having all of the features and/or elements of any one of the devices, systems or methods described below or to features common to some or all of the devices and or methods described herein. It is possible that there may be a device or method described herein that is not an embodiment of any claimed subject matter. Any subject matter that is described herein that is not claimed in this document may be the subject matter of another protective instrument, for example, a continuing patent application, and the applicants, inventors or owners do not intend to abandon, disclaim or dedicate to the public any such subject matter by its disclosure in this document.

It will be appreciated that for simplicity and clarity of illustration, where considered appropriate, reference numerals may be repeated in the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have a mechanical, electric, or thermal connotation. For example, as used herein, the terms coupled or coupling can indicate that two elements or devices can be directly connected to one another or connected to one another through one or more intermediate elements, devices or mechanical elements, or through an electric signal or electrical contact, or through thermal conduction or radiation, depending on the particular context.

It should also be noted that the term "vacuum" should be understood as being a low pressure state relative to ambient pressure down to and including a perfect vacuum.

Unless the context requires otherwise, throughout the specification and claims which follow, the word "comprise" and variations thereof, such as, "comprises" and "comprising" are to be construed in an open, inclusive sense, that is, as "including, but not limited to".

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5% or 10%, for example, if this deviation does not negate the meaning of the term it modifies.

Furthermore, the recitation of numerical ranges by endpoints herein include all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

Reference throughout this specification to "one embodiment", "an embodiment", "at least one embodiment" or "some embodiments" means that one or more particular features, structures, or characteristics may be combined in any suitable manner in one or more embodiments, unless otherwise specified to be not combinable or to be alternative options.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

In one aspect, in accordance with the teachings herein, there is provided at least one example embodiment of a container (e.g., a refrigerated container) that can maintain a refrigerated internal environment for relatively long periods of time for liquids, materials or compositions stored therein. Such containers are relatively small, light and easy to transport.

Referring now to FIG. 1, pictured therein is an example embodiment of a refrigerated container 100. The container 100 comprises an insulated body 102. In the embodiment of FIG. 1, the insulated body 102 is shaped as a substantially cylindrical cup. The insulated body 102 is comprised of stainless steel. In other examples, the insulated body 102 may be comprised of other materials including, but not limited to, aluminum, steel, glass, wood and polymer materials, for example.

The insulated body 102 of the container 100 is insulated by vacuum insulation. The walls of the insulated body 102 are comprised of two thin layers of stainless steel, separated by a gap. This gap is at least partially evacuated, such that the absolute pressure within the gap is significantly less than about 1 atm. The absence of air or another gas within this gap significantly reduces the rate of heat transfer through the walls of the insulated body 102.

In at least one other example embodiment of the container 100, the insulated body 102 may be provided with thermal insulating properties through other means. For example, the insulated body 102 may comprise expanded polystyrene insulation, fiberglass insulation, air-gap insulation, aerogel-based insulation or any other suitable method of insulation for thermally insulating small, portable containers.

The container 100 comprises a lid 104. The lid 104 is couplable to the insulated body 102. When the lid 104 is coupled to the insulated body 102, the container 100 is substantially sealed from the environment. Fluids may not readily enter or exit the container 100 when lid 104 is coupled to the insulated body 102.

In the example container 100 of FIG. 1, the lid 104 is comprised of a polymer material. In other examples, the lid 104 may comprised of other materials including, but not limited to, steel, aluminum, glass, wood, and cork.

In the example container 100 of FIG. 1, the lid 104 couples to the insulated body 102 through a threaded mechanism. Threads are present along the inside upper edge of insulated body 102. Corresponding opposing threads are present on the lower exterior of lid 104. An operator may engage the threads of the lid 104 with the threads of the insulated body 102 by placing lid 104 onto insulated body 102. An operator may then rotate lid 104 clockwise, engaging the opposing threads of each component, securing the lid 104 to the insulated body 102. In other example embodiments, other mechanisms may be used to secure the lid 104 to the insulated body 102.

When the lid 104 is coupled to the insulated body 102, the interior of the container 100 is relatively thermally insulated from the environment that is external to the container 100. For example, the rate of heat transfer of the sealed embodiment of FIG. 1 is less than about 1.4 W to about 2.45 W for an unpowered coupled operation and less than about 0.7 W to about 1.25 W for an unpowered decoupled operation for a difference in temperature of between about 20 to 35 degrees Celsius based on experimental data from a prototype.

The lid 104 further comprises a heatsink 106. The heatsink 106 extends through the lid 104, from the interior of the sealed container 100 to the exterior of the sealed container 100. The heatsink 106 promotes the conduction of heat from the inside of the container 100 to the outside of the container 100, and to the environment, or vice versa depending on the temperature gradient present between the inside and outside of the container 100. The heatsink 106 may be made using aluminum, copper, or any other materials that have a high heat conductivity.

Figure 2:
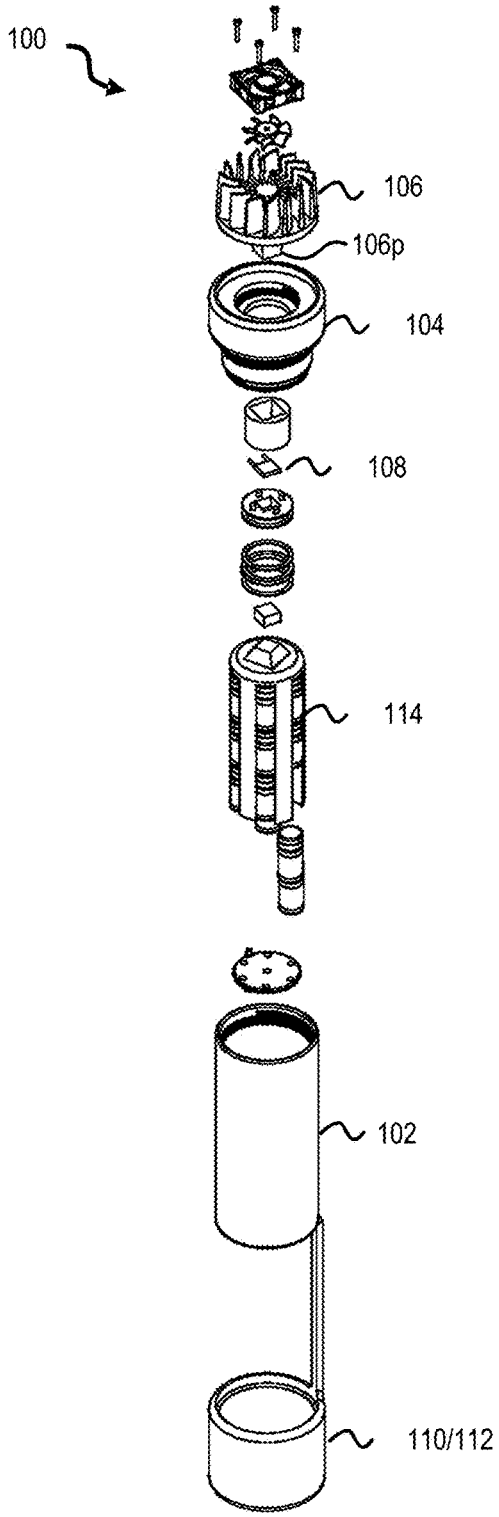
FIG. 2 is an exploded view of an example embodiment of a refrigerated container.

In various embodiments, the external heatsink 106 has an upper portion with fins or radiating elements for radiating heat to the external environment. The external heatsink 106 also includes a lower portion having a stem or piston 106*p*, such as is shown in FIG. 2. The piston 106*p* extends through the lid 104 to make thermal contact with an upper portion of the interior heatsink of the insulated body 102 of the container 100. The piston shape may be used to facilitate a zero-volume condition when the piston is in a down position (i.e., during a coupled configuration). This may aid in removing air from the decoupling chamber (i.e., the chamber between the internal and external heatsinks in the decoupled configuration). The circular shape allows for rotation of the piston 106*p* (and therefore the external heatsink 106) when the threads are spun on the decoupler (e.g., upper portion of the lid). This allows for the piston 106*p* and the threaded section to be made as a single piece.

Container 100 additionally comprises a cooling element 108. Cooling element 108 may promote the transfer of heat between the inside of the container 100 and the outside of the container 100, or vice versa. In at least one example embodiment, the cooling element 108 may be at least one thermoelectric (TE) cell such as a Peltier cooler. In such embodiments, the cooling element 108 may comprise an internal side, and an external side. The application of a first electrical current to the electrical leads of the Peltier cooler promotes transfer of heat from the internal side, to the external side. When the direction of the first electrical current applied to the Peltier cooler is reversed, the direction of heat transfer may be reversed in which case the Peltier cooler may promote the transfer of heat from the external side to the internal side.

While the description generally refers to a Peltier cooler it may be possible that other thermoelectric cells may be used in the various embodiments described herein.

In at least one example embodiment, the cooling element 108 may comprise multiple sub elements, such as multiple Peltier coolers. In such embodiments, the TE cells may be physically arranged so that they are thermally in series and are electrically coupled in parallel. Other embodiments may have thermally parallel TE cells. In at least one example embodiment, the cooling element 108 may be a TE Technology TE-35-0.6-1.0 Peltier cooler or other suitable Peltier cooler.

The container 100 additionally comprises an energy source 110 such as is shown in FIG. 2. The energy source 110 may be electrically connected to the cooling element 108 to provide energy to the cooling element 108 which in turn promotes the transfer of heat. In at least one example embodiment, the energy source 110 may be an electrical energy source, such as a chemical battery or a fuel cell, which provides an electrical current to the cooling element 108 to provide energy thereto. Examples of chemical batteries may include lithium batteries, nickel metal hydride batteries, alkaline batteries, lead acid or any other suitable battery. In at least one other example embodiment, the energy source 110 may be an external power supply, wherein the container 100 is connected to the external power supply using a power cable, such as a DC power cable, a USB power cable, or an AC power cable. The external power supply may be used to recharge the internal energy source 110. Alternatively, in at least one alternative embodiment, the external power supply may interface with the container 100 wirelessly, such as through the Qi wireless power protocol. In at least one example embodiment, there may be both an internal energy source, such as a battery type energy source 110 and an external energy source, such as a DC power cable. Alternatively, in at least one embodiment, the external power supply may be a portable solar panel that is electrically couplable to the cooling element 108.

The cooling element 108 is coupled to the heatsink 106, such that the cooling element 108 is in thermally conductive contact with the heatsink 106. When the cooling element 108 is in operation, heat is transferred from one end of heatsink 106 to the other end of heatsink 106, depending on the direction of operation of cooling element 108.

In at least one example embodiment, the cooling element 108 may be coupled to the heatsink 106 such that the cooling element 108 is positioned within the heatsink 106, and promotes heat transfer from one end of heatsink 106 to the other end of heatsink 106.

Alternatively, in at least one example embodiment, the heatsink 106 may be separable into two portions, an internal portion and an external portion. The internal side of cooling element 108 may be in thermal contact with the internal portion of the heatsink 106, and the external side of the cooling element 108 may be in thermal contact with the external portion of the heatsink 106.

Figures 3, 4, 5:
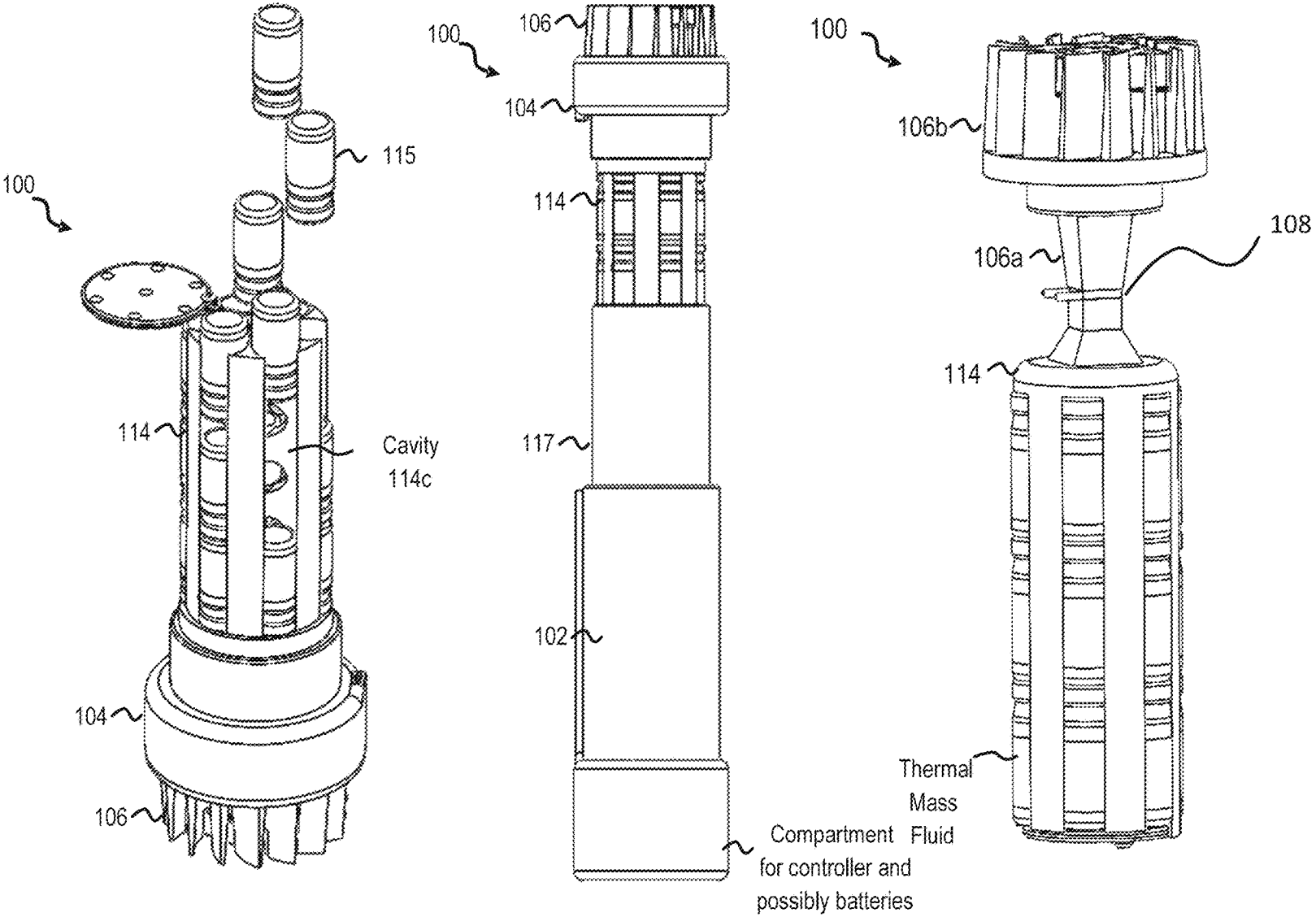
FIG. 3 is an exploded view of the lid, heatsink, and carriage portion of the refrigerated container shown in FIG. 1.
FIG. 4 is an exploded view of an example embodiment of a refrigerated container.
FIG. 5 is an isometric view of the internal heatsink, external heatsink, cooling element and carriage portion of an example embodiment of a refrigerated container being partially assembled.

Referring now to FIGS. 3 to 5, the heatsink 106 may generally comprise a carriage portion 114, which may be a section of, or extends from, the internal portion of heatsink 106. The carriage portion 114 of the heatsink 106 may comprise a substantially cylindrical structure with a plurality of cavities 114*c* (only one of which is labelled for simplicity). Vessels 115 of substances, fluids, materials or compositions that one wishes to keep temperature-controlled may be placed into the cavities. By placing the vessels 115 into the cavities 114*c*, the vessels 115 may be in thermal communication with the walls of the carriage portion 114, and therefore, the heatsink 106. This may allow for more efficient heat transfer to and from the vessels 115 which an individual wishes to temperature control, resulting in more effective temperature control and consistency. Additionally, the carriage portion 114 provides more thermal mass (i.e., heat capacity) to the internal system (e.g., internal elements) of the container 100. Consequently, for each watt of heat gain or loss from or to the environment, the internal temperature of the container 100 will vary less.

In at least one example embodiment, the vessels 115 may be vials. In some cases, the vials may contain a pharmaceutical composition such as a medication or a vaccine.

Figure 10:
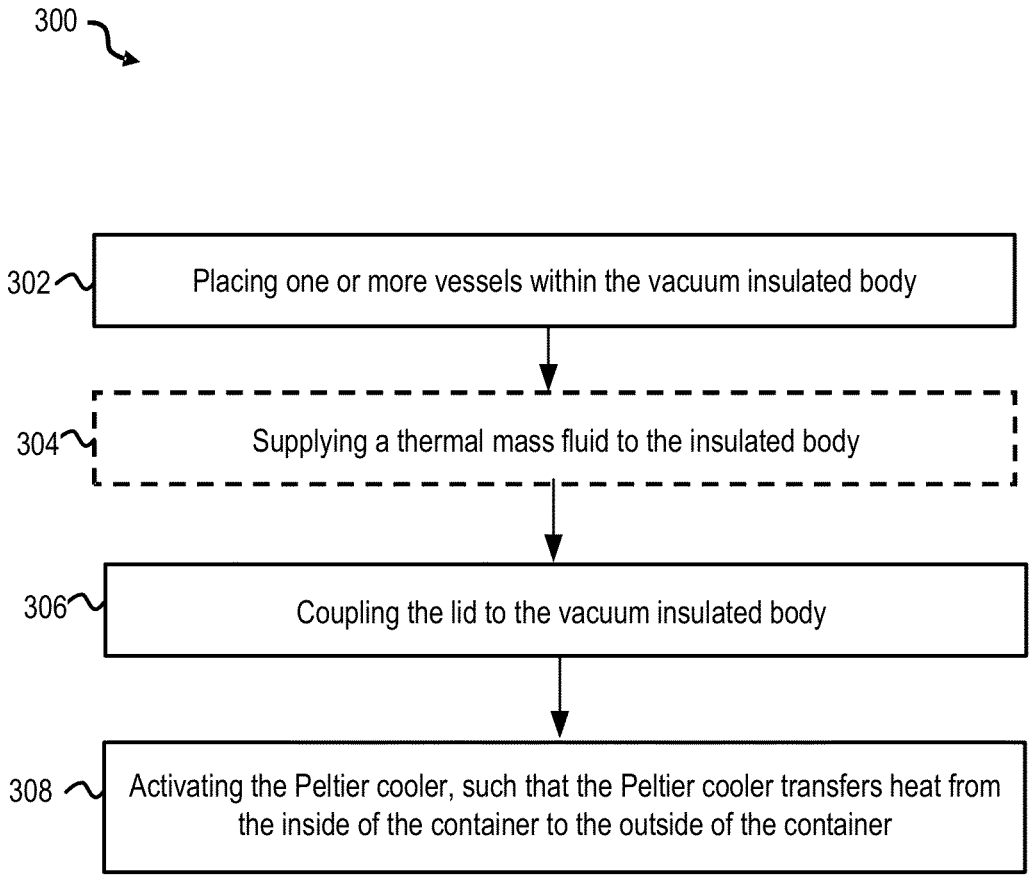
FIG. 10 is a flow chart diagram of an example embodiment of a method of use of at least one of the refrigerated containers described herein.

The carriage portion 114 may be comprised of a cast alloy. It may be advantageous to manufacture carriage portion 114 out of an alloy that has a high thermal conductivity, and is highly castable, in order to balance thermal properties and manufacturing convenience. Alternatively, the carriage portion 114 may be machined. However, it may be much more economical to cast the carriage portion 114 instead of machining it due to its specific geometry, as shown in FIGS. 3, 5 and 10.

In at least one example embodiment, an operator may deposit a thermal mass fluid into the insulated body 102 before sealing the container 100. The thermal mass fluid may be water, ethanol, propylene glycol or any other fluid that stays in liquid form throughout the operating temperatures of the container 100 and possesses a relatively high specific heat capacity.

The operator may place the carriage portion 114 into the insulated body 102, submerging each vessel 115 into the thermal mass fluid contained within the insulated body 102 when inserting carriage portion 114 into the insulated body 102. The thermal mass fluid provides the advantage of increasing the heat capacity of the temperature-controlled elements internal to the container 100. For each watt of heat transferred into or out of container 100, a higher heat capacity for the temperature-controlled elements will result in a smaller magnitude of temperature change. As the intended use of the container 100 is generally for refrigerated transport of materials, fluids or compositions, to maintain these within specific temperature ranges, a higher internal heat capacity may be desirable. Additionally, the presence of the thermal mass fluid may provide more efficient heat conduction into or out of the vessels 115, and also provide the vessels 115 with shock protection for instances wherein the container 100 is knocked, dropped or otherwise impacted during transport or handling.

The presence of a higher thermal mass within the insulated body 102 additionally means that in order to cool or heat the contents of the container 100 to a target temperature, more heat transfer may be required. The target temperature is the desired internal temperature of the insulated body 102. This may be addressed by cooling or heating all internal components, including the carriage portion 114, the vessels 115, and the thermal mass fluid to the target temperature before placing these elements into the container 100. The thermal mass fluid can be contained in an inner sleeve 117 (see FIG. 4) that covers the carriage portion 114 (e.g., vessel holder) and the vessels 115. The inner sleeve 117 can be used to reduce the quantity of the heat transfer medium used to the places where it is effective. This reduces weight and improves insulation by creating an air gap between refrigerated contents and inner walls of the vacuum flask (e.g., insulated body 102), and increases the rate at which the temperature of the contents of the vessels 115 can be dropped. Alternatively, the thermal mass fluid can be added to the inside of the container 100 without the sleeve. For example, if the container 100 is being used to refrigerate vials during transport, the vials may be kept in a refrigerated environment, taken from the refrigerated environment when they are to be transported and then placed into the container 100. Similarly, the carriage portion 114 and/or thermal mass fluid may be taken from a refrigerated environment before being placed into the container 100. Afterwards, the internal temperature of the container 100 will be nearer to the target temperature, and will remain relatively stable.

In at least one example embodiment, the container 100 may additionally comprise a controller 112 (see FIG. 2). The controller 112 may comprise a processor, a memory, a temperature sensor and an I/O controller (all not shown). The temperature sensor may be embedded or mounted to the heatsink 106, or the carriage portion 114 in examples wherein a carriage portion 114 is present. The controller 112 may be coupled to both the cooling element 108, and the energy source 110.

In some examples, container 100 may be further equipped with a solar cell (not shown). The solar cell may be configured to supply a current to the energy source 110 to recharge the energy source 110, and/or controller 112 in embodiments wherein the container 100 comprises a controller 112.

The container 100 allows for the regulation of the internal temperature of the container 100 when the lid 104 is coupled to insulated body 102. The cooling element 108 promotes transfer of heat from the interior of container 100 to the outside of the container 100, or vice versa, through heatsink 106.

Figure 8:
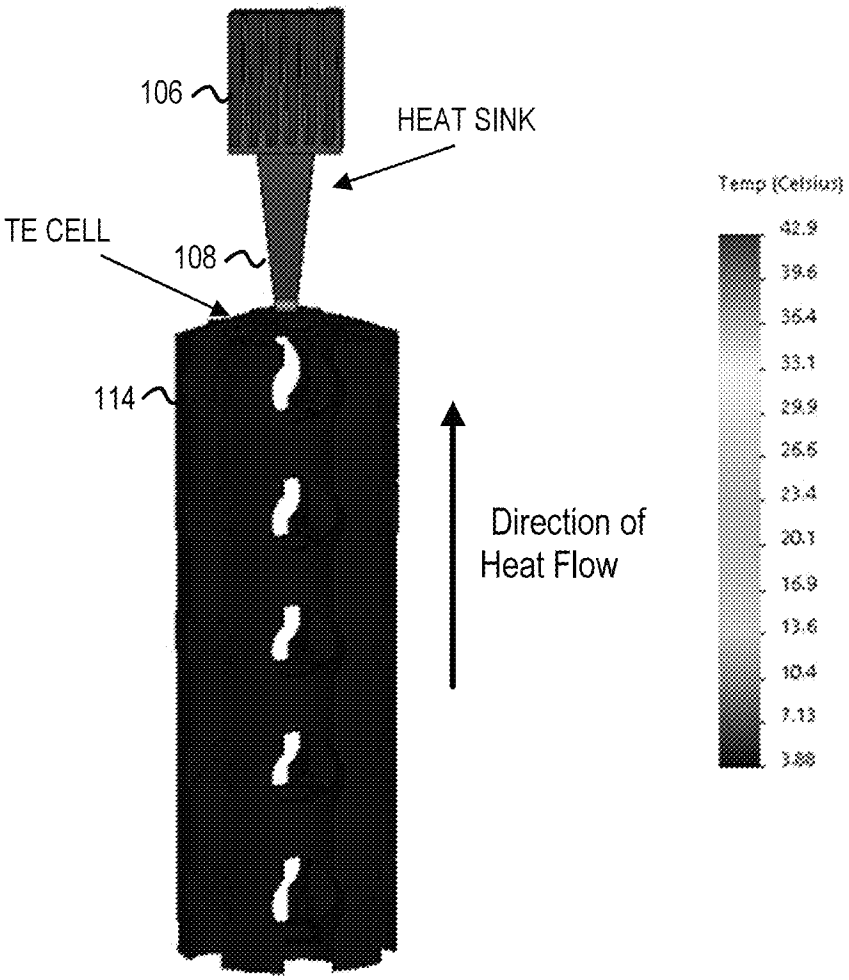
FIG. 8 is a depiction of the output of a thermal simulation of the heatsink, cooling element and carriage portion of a refrigerated container.
Figure 8:
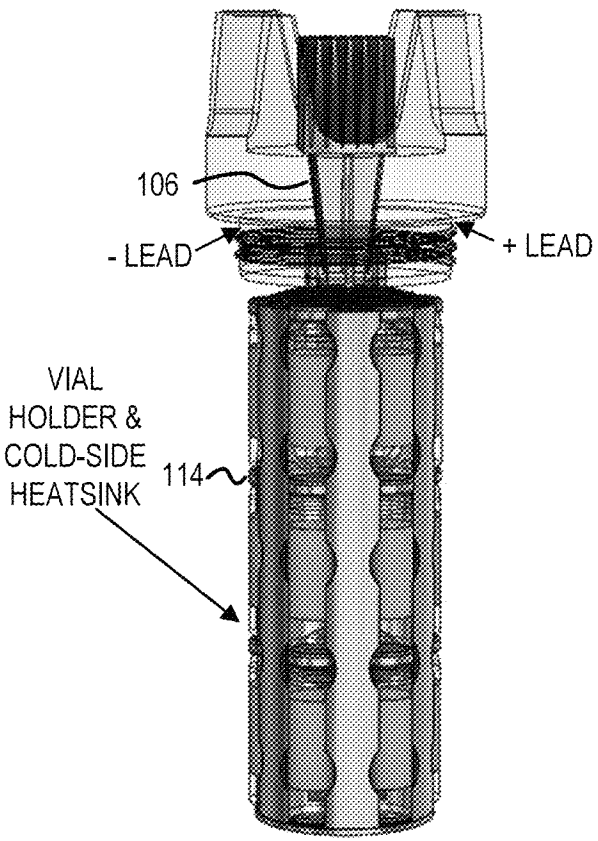

For example, the container 100 may be used to keep the internal temperature of the container 100 below the ambient temperature. Vessels containing substances, for which there is a desire to keep cool, may be placed within the container 100, and the container 100 may be sealed with the lid 104. The cooling element 108 may be activated, such that the cooling element 108 promotes the transfer of heat from the internal side of the cooling element 108, to the external side of cooling element 108. The heat may be absorbed from the internal portion of the heat sink 106 by the cooling element 108 and transferred to the external portion of the heat sink 106. The internal portion of the heatsink 106 is exposed to the interior of the container 100, readily absorbing heat from the inside of the container 100. The external portion of the heat sink 106 is exposed to the environment exterior to the container 100. When the cooling element 108 is activated, promoting heat transfer from the internal portion to the external portion of the heatsink 106, heat is transferred from the inside of the container 100 to the external portion of heatsink 106. The external portion of heatsink 106 may increase in temperature as it absorbs this heat. This heat may then be transferred to the external environment through convection, conduction and/or radiation. An example of this is shown in FIG. 8.

In at least one example embodiment, the container 100 may additionally comprise a fan (see FIG. 14) that is coupled to the external portion of the heatsink 106, to increase airflow across the external portion of the heatsink 106 from the environment, promoting convective heat transfer to, and/or, from the heat sink 106 to the environment.

The transfer of heat from the inside of the container 100 to the external environment reduces the internal temperature of the container 100 below the ambient temperature. This provides a refrigerated environment for the storage and transport of materials that require refrigeration. The container 100, through the combination of active refrigeration, and vacuum insulation, may allow the internal temperature of the container 100 to be maintained below the ambient temperature for time periods longer than possible with a non-refrigerated vacuum insulated flask. The cooling element 108 may transfer as much heat out of the interior of the container 100 as is transferred into the container 100 from the environment which is a steady state condition. This steady state condition allows the internal temperature of the container 100 to be maintained below the ambient temperature for as long as energy is supplied to the cooling element 108 and the cooling element 108 is able to operate to maintain the steady state condition.

Similarly, at least one component of the container 100 may be configured to maintain an internal temperature that is higher than the ambient temperature for long periods of time. For example, in this case, the cooling element 108 may be operated in reverse, transferring heat from the external portion of the heatsink 106, to the internal portion of the heatsink 106. Heat is absorbed from the environment into the external portion of heatsink 106, and then this heat is transferred to the internal portion of the heatsink 106. The addition of heat may raise the temperature of the internal portion of the heatsink 106 above the internal temperature of the container 100, which in turn causes heat to transfer to the interior of the container 100 thereby raising the internal temperature of container 100.

In example embodiments in which the container 100 comprises a controller 112, the controller 112 may be configured, through a software program that is stored on the memory and executed by the processor, to automatically manage the cooling/heating process of the container 100. For example, an operator may "program", through manipulation of the software program, the container 100 to maintain its internal temperature at a target temperature of 3° C., while the external temperature is approximately 20° C. In this case, the controller 112 may continuously measure the internal temperature of the container 100 using its temperature sensor and compare the measured temperature to the target temperature. In response to the comparison, the controller 112 may adjust the flow of current from the energy source 110 to cooling element 108 to drive the internal temperature of the container 100 to the target temperature. For example, if the internal measured temperature is first measured at 20° C., the controller 112 may supply the maximum amount of current from the energy source 110 to the cooling element 108, for maximum heat transfer out of the container 100. As heat is removed from the inside of the container 100, the internal temperature of the container 100 may approach 3° C. Once the internal temperature of the container 100 approaches 3° C., the controller 112 may decrease the current supplied to the cooling element 108 from the energy source 110. When the temperature measured by the controller 112 is approximately the target temperature, the controller 112 may finely adjust the current supplied to the cooling element 108 such that the temperature measured by the temperature sensor is at about the target temperature. Other control methods for maintaining the internal temperature using a cooling/heating element and temperature sensor feedback may be used by controller 112 for maintaining the internal temperature of the container 100 at the target temperature.

Figure 7:
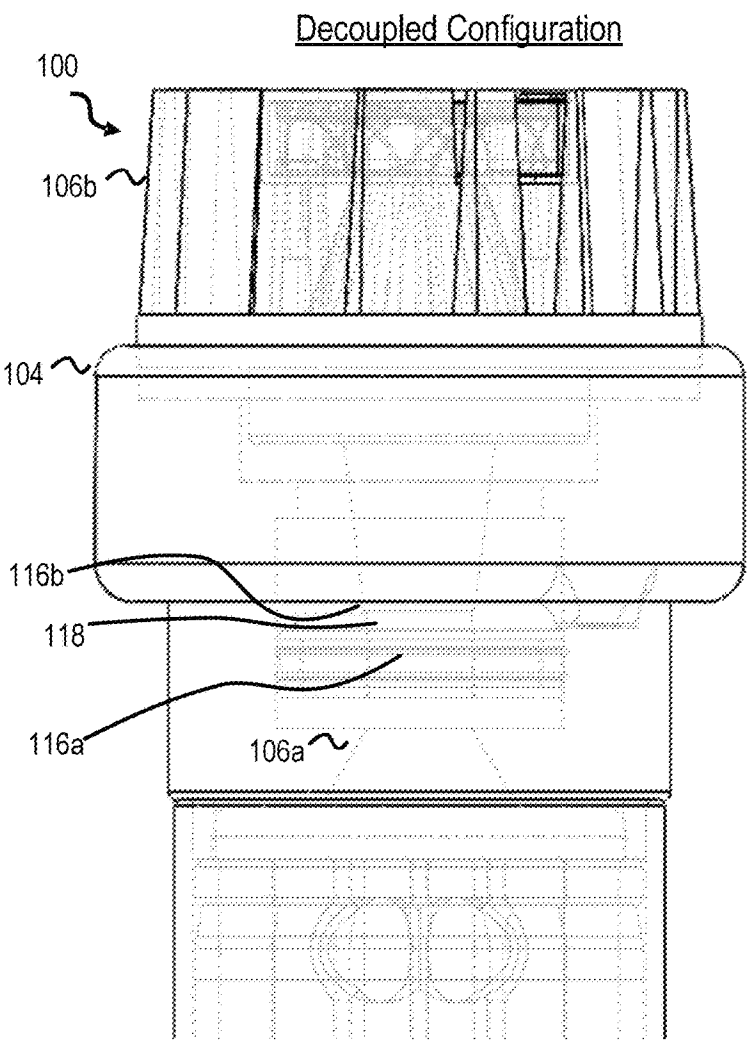
FIG. 7 is an enlarged view of the example embodiment of the refrigerated container of FIG. 6 in an uncoupled configuration.
Figure 6:
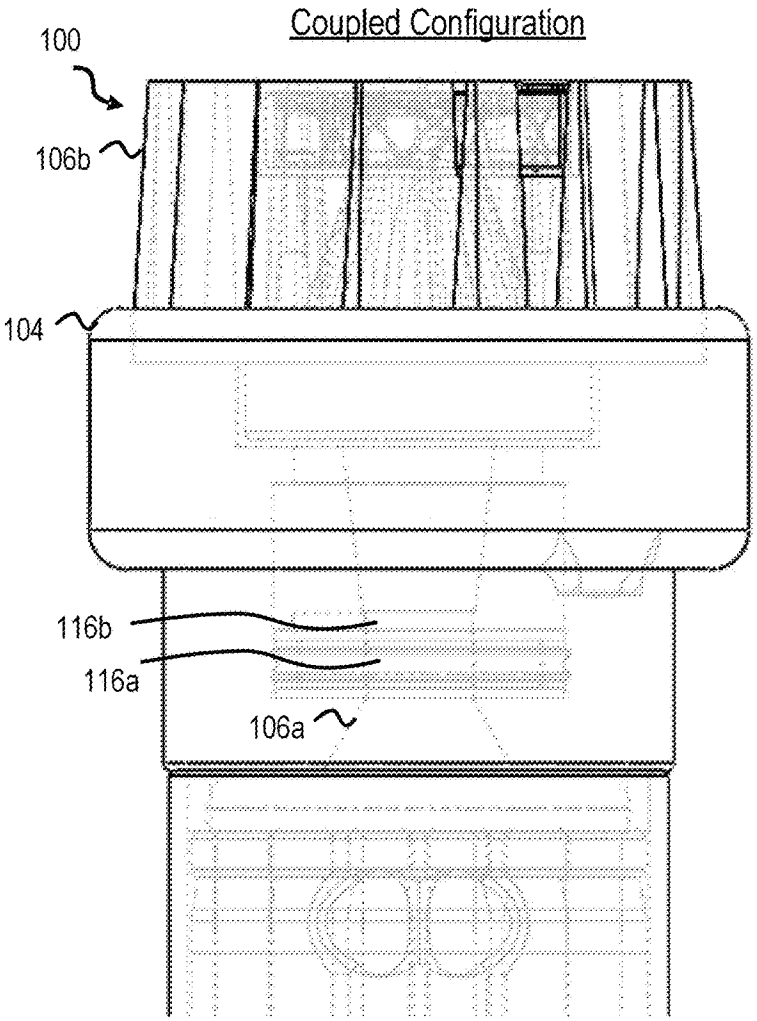
FIG. 6 is an enlarged view of an example embodiment of a refrigerated container in a coupled configuration.

In at least one example embodiment, the container 100 may comprise two configurations including a coupled configuration and an uncoupled configuration. Referring now to FIGS. 6 and 7, in such embodiments, the heatsink 106 of the container 100 may comprise an internal heatsink 106*a* and an external heatsink 106*b*. The internal heatsink 106*a* comprises internal heatsink interface 116*a*. External heatsink 106*b* comprises external heatsink interface 116*b*. The coupled configuration allows for relatively efficient heat transfer between the internal heatsink 106*a* and the external heatsink 106*b*. The uncoupled configuration inhibits heat transfer between the internal heatsink 106*a* and the external heatsink 106*b*.

In the coupled configuration shown in FIG. 6, the internal heat sink interface 116*a* and external heat sink interface 116*b* are engaged, such that heat may readily conduct between the internal heat sink 106*a* and the external heat sink 106*b*. In some examples, internal heat sink interface 116*a* and external heat sink interface 116*b* may each be substantially planar. The coupled configuration forces the internal heat sink 106*a* and the external heat sink 106*b* together at their interfaces 116*a* and 116*b*, respectively, to promote maximum thermal conductivity.

In at least one example embodiment, the internal heat sink interface 116*a* and external heat sink interface 116*b* may both be treated to maximize heat conduction across interfaces when engaged, for example, by polishing each interface to a smooth finish, or by applying a thermal compound to one or both interfaces. For polishing, 600 grit or finer grits may be used. The minimum grit level may be about 240 in some cases. The thermal compound may be, but is not limited to, an off the shelf thermal paste or a graphite pad, for example.

In the uncoupled configuration (see FIG. 7), the internal heatsink 106*a* and the external heatsink 106*b* are separated by a vacuum volume 118. The vacuum volume 118 is a void volume between the internal heat sink interface 116*a* and external heat sink interface 116*b*. The vacuum volume 118 is substantially evacuated, and comprises an absolute pressure much lower than 1 atm. The vacuum volume 118 does not allow for heat transfer or allows very little heat transfer which allows the internal temperature of the container 100 to be maintained for a longer period of time.

In at least one example embodiment of the container 100 that has a lid which can be moved between coupled and uncoupled configurations, the container 100 may further comprise a mechanism for switching the lid from the coupled configuration to the uncoupled configuration and vice versa. The external heatsink 106*b* may be coupled to the lid 104 with a threaded mechanism. When the external heatsink 106*b* is rotated, the external heatsink 106*b* is translated axially.

For example, when the lid 104 of the container 100 is in the coupled configuration, where the external heatsink 106*b* and internal heatsink 106*a* are in contact with each other, when an operator rotates the external heatsink 106*b* counterclockwise, the external heatsink 106*b* translates axially away from the internal heatsink 106*a*. The walls of the lid 104 surrounding the portion of the external heatsink 106*b* that translate axially away from the internal heatsink 106*a* are relatively fluidically sealed, such that when the vacuum volume 118 opens during the translation from the coupled to the uncoupled configurations, fluids such as ambient air may not enter vacuum volume 118. In some examples, polymer gaskets may be present around the edge of external heatsink interface 116*b* to promote fluid sealing and gaskets may also be used to seal the lid of the insulated vessel. Element 116*a* also represents a gasket that seals between the piston and piston wall.

As a result, when switching from the coupled configuration to the uncoupled configuration, the vacuum volume 118 is created. The vacuum volume has an absolute gas pressure of much less than 1 atm. The low absolute gas pressure within vacuum volume 118 may significantly reduce heat transfer between internal heatsink 106*a* and external heatsink 106*b* versus the coupled configuration.

It may be advantageous to switch from the coupled configuration, when heat is actively transferred using the cooling element 108, to the uncoupled configuration, when heat is not actively being transferred using the cooling element 108. For example, the cooling element 108 may be operated until the internal temperature of container 100 reaches the target temperature. The lid 104 of the container 100 may then be switched from the coupled configuration to the uncoupled configuration, and the cooling element 108 may be deactivated. At this point, the internal temperature of the container 100 is near the target temperature, and the rate of heat transfer from the inside of the container 100 to the external environment is reduced to the minimum possible amount. When heat transfer through the container 100 varies the internal temperature of container 100 such that the internal temperature is outside of the target temperature range, the container 100 may be switched back to the coupled configuration and the cooling element 108 may be reactivated. This configuration reduces the total energy consumption of the cooling element 108 required to maintain the internal temperature of the container 100 at a certain set point, i.e., at a target internal temperature.

Alternatively, since some Peltier coolers operate most efficiently at maximum heat output, instead of modulating the Peltier cooler output, an "on-off" control scheme may be used to maintain the internal temperature of container 100 within a target temperature range. During each "on cycle", the container 100 may be set to the coupled configuration. During each "off cycle", the container 100 may be set to the uncoupled configuration.

Figure 9C:
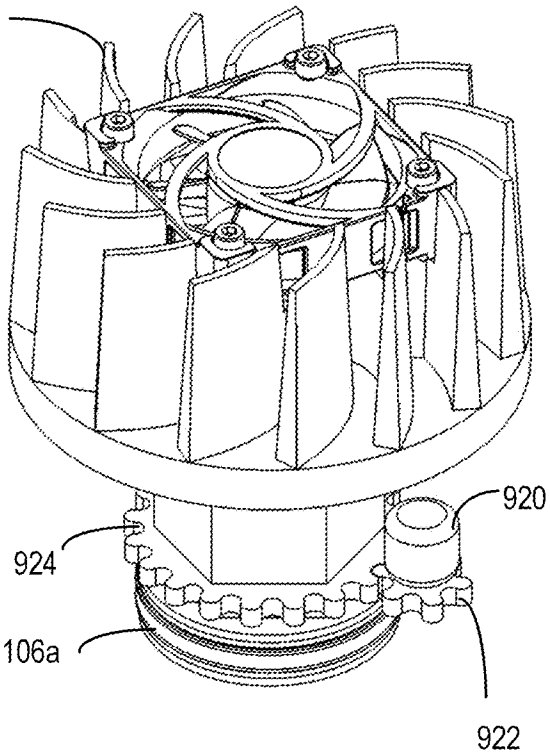
FIGS. 9A, 9B and 9C show a side view, a bottom isometric view and a top isometric view, respectively, of an example embodiment of a powered thermal decoupling mechanism for a refrigerated container.
Figure 9B:
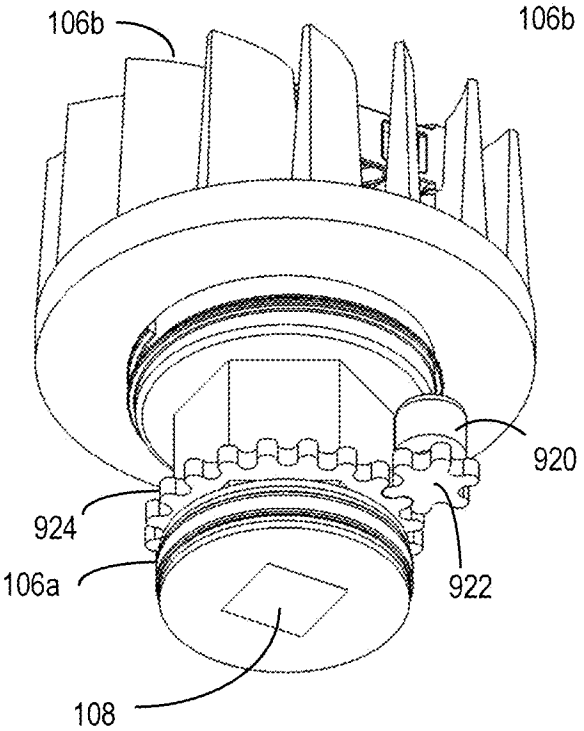
Figure 9A:
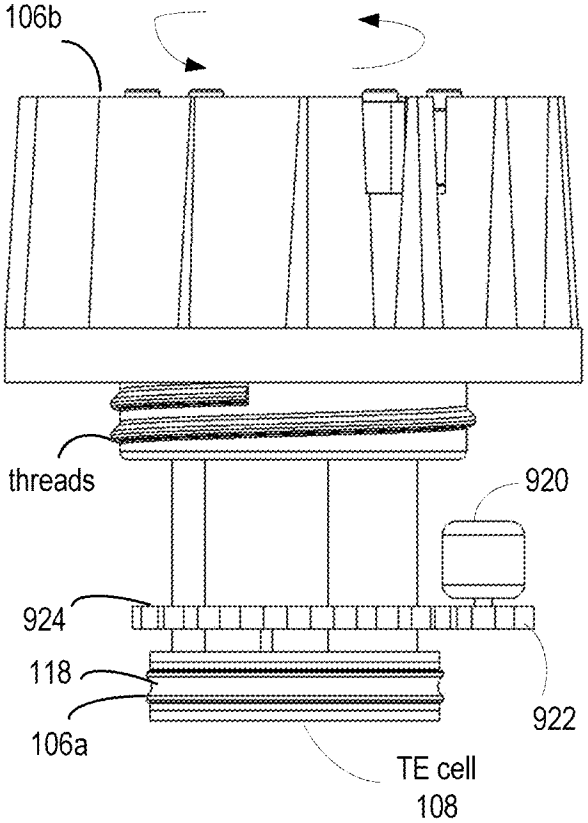

Referring now to FIGS. 9A-9C, in at least one example embodiment, the container 100 may comprise a powered mechanism for providing an automatic switching from the coupled configuration to the uncoupled configuration and vice versa. The powered mechanism may comprise a stepper motor 920 with a gear 922 and a driven gear 924 that is coupled to the external heatsink 106*b*. When a current is applied to the stepper motor 920, the external heatsink 106*b* is rotated, along the threads described above in reference to the switching mechanism. The direction of rotation reverses when the direction of the current applied to the stepper motor 920 is reversed. This rotation may actuate the external heatsink 106*b* towards or away from the internal heatsink 106*a*, closing or creating the vacuum volume 118.

In at least one embodiment where the container 100 comprises a controller 112, the powered mechanism may be coupled to, and automatically managed by, the controller 112. For example, it may be desired to maintain the internal temperature of the container 100 at a target temperature. In such cases, the controller 112 may be configured to activate the cooling element 108 to reduce the internal temperature of container 100. The controller 112 may simultaneous direct the powered mechanism to set the container 100 to the coupled configuration, such that heat may be efficiently transferred out of container 100. When the internal temperature of the container 100 reaches the target temperature, the controller 112 may be configured to deactivate the cooling element 108, and direct the powered mechanism to set the container 100 to the decoupled configuration to minimize heat transfer into or out of container 100. This controller automated configuration may significantly reduce power consumption by the cooling element 108 that is required to maintain a given internal temperature, therefore allowing container 100 to maintain a given internal temperature for longer periods of time with a fixed energy source.

Figure 9D:
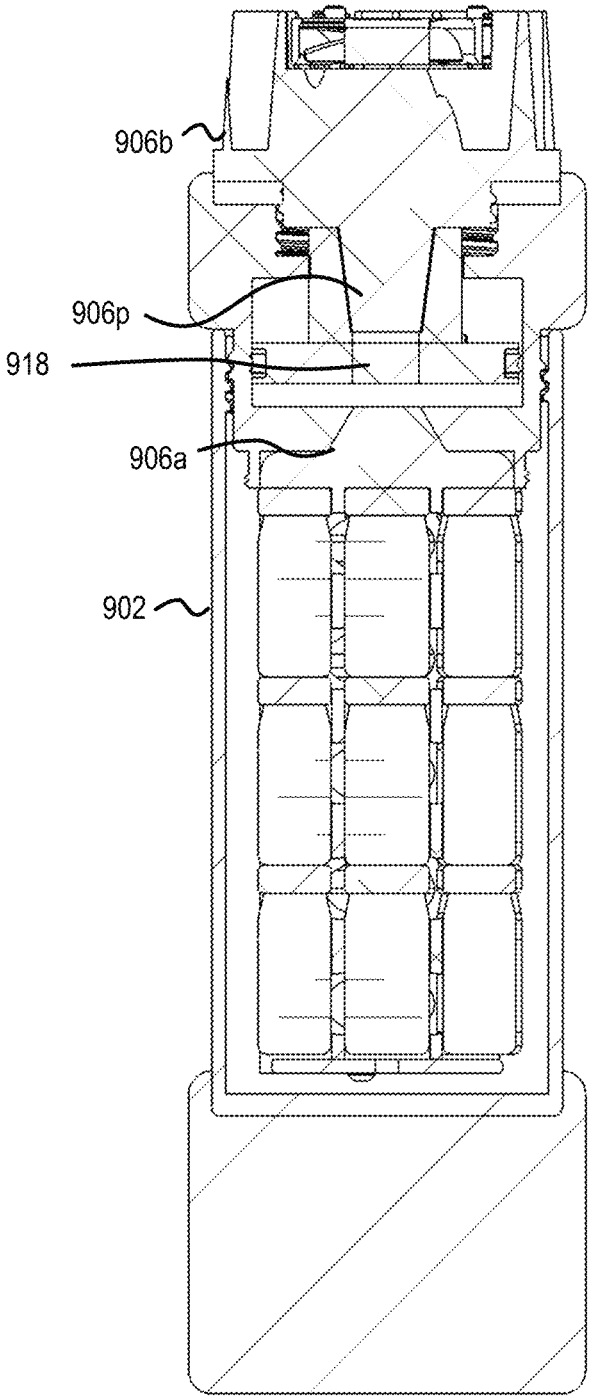
FIG. 9D is a side view of an example embodiment of a refrigerated container having a large diameter thermal decoupling system.

Referring now to FIG. 9D, in another alternative embodiment, there is provided a lid couplable to an insulated body 902, that includes an internal heatsink 906*a* and an external heatsink 906*b* with an extra wide piston 906*p* for providing a larger diameter vacuum insulated column 918. The large diameter of the vacuum insulated column 918 provides for improved insulation on the lid. As partial vacuums have insulating properties, the increased diameter of the vacuum insulated column can reduce the thermal conductance of the lid.

In at least one embodiment, a valve may be used to reset the vacuum chamber in the coupled position. This may be used if there is any leakage in the vacuum system. It will also aid in manufacture as it no longer necessitates a vacuum chamber in which to make the device. This is thanks to the cycler design going to a zero-volume state when at the bottom of the stroke.

In another aspect, in at least one embodiment in accordance with the teachings herein, at least one of the containers described herein may be used for warming and do not exclusively use the Peltier effect. In such embodiments, the Seebeck effect may be used to warm the interior of the container by reversing the voltage polarity of the thermoelectric cell. This is useful when transporting contents that need to be stored and/or transported in warm environments such as in the storage or transport of mammalian cell cultures, for example.

In at least one embodiment, the container may further comprise a fan that is coupled to the external heatsink and is operated to transfer additional heat away from the external heatsink when heat is being transferred out of the interior of the container to the surrounding environment.

In at least one embodiment, the container may also comprise a radiator that is coupled to the external heatsink to receive heat transfer from the external heatsink. The radiator may be filled with fluid and provide additional heat capacity for transferring heat out of the interior of the container to the surrounding environment.

In at least one embodiment, the container may further comprise a decoupling mechanism for decoupling the exterior heatsink interface from the interior heatsink interface, wherein the decoupling mechanism is manual or automatic.

In at least one embodiment that has the decoupling mechanism, the decoupling mechanism may be geared and/or cammed.

Figure 11:
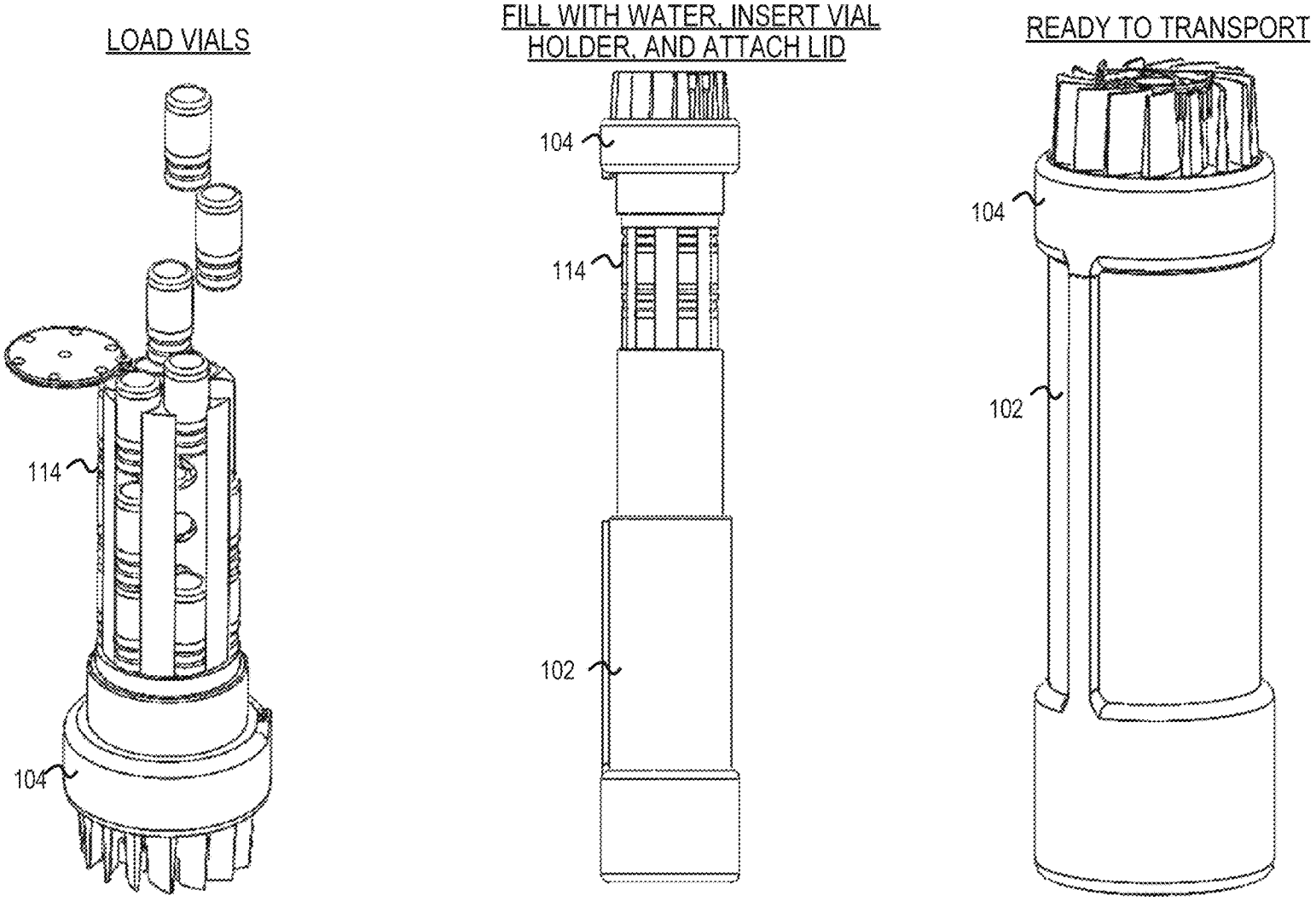
FIG. 11 demonstrates in pictorial form a method of loading a refrigerated container.

Referring now to FIG. 10, pictured therein is a flow chart illustrating an example embodiment of a method 300 of refrigerated transport, using an embodiment of the container 100 described in accordance with the teachings herein. An embodiment of method 300 is shown pictorially in FIG. 11.

Method 300 begins with step 302. An operator obtains the container 100 and vessels 115 and removes the lid 104 of the container 100 from the insulated body 102. The operator then places the vessels 115 into the insulated body 102 of the container 100. The vessels 115 may contain any substance, sample, material or any other matter which is desired to be maintained at a specific temperature (i.e., the target temperature). In embodiments wherein the heatsink 106 further comprises a carriage portion 114, the operator may place the vial into a cavity of the carriage portion 114 instead of directly into insulated body 102. The carriage portion 114 may then be placed into the insulated body 102.

Method 300 may optionally additionally include step 304. In embodiments where the insulated body 102 comprises a thermal mass fluid, the operator may deposit the thermal mass fluid into insulated body 102. In embodiments where the container 100 comprises the carriage portion 114, the operator may then place the carriage portion 114 into the insulated body 102. After step 304, the vessels are submerged in the thermal mass fluid.

At step 306, the lid 104 is coupled to the insulated body 102. In embodiments where the lid 104 couples to the insulated body 102 through a threaded/screw mechanism, the operator may screw the lid 104 onto the insulated body 102. In other embodiments, the operator may make use of a different mechanism to couple the lid 104 to the insulated body 102.

At step 308, the cooling element 108 of the container 100 may be activated. In some embodiments, the cooling element 108 may be a Peltier cooler. Once the cooling element 108 is activated, the internal temperature of container 100 may reach the target temperature and the cooling element 108 may then be deactivated.

Although not shown in FIG. 10, in embodiments where the container 100 can be set to the coupled or uncoupled configurations, the method 300 may include another step when the internal temperature of the container 100 reaches the target temperature. In this case, the container 100 may be placed in a decoupled configuration and the cooling element 108 may be turned off. As another option, as the internal temperature of the container 100 varies the container 100 may be moved to the coupled configuration and the cooling element 108 activated until the internal temperature of the container 100 reaches the target temperature or is in an acceptable temperature range, at which point the container 100 may be moved to the decoupled configuration and the cooling element 108 is deactivated.

The process for determining the external heat sink may involve picking a TE cell from a supplier (such as TE technology, e.g.), creating an external heat sink and simulating the waste heat being rejected through the external heat sink. The waste heat for the chosen TE cell may be read from the cell specification charts from the supplier.

Figure 12:
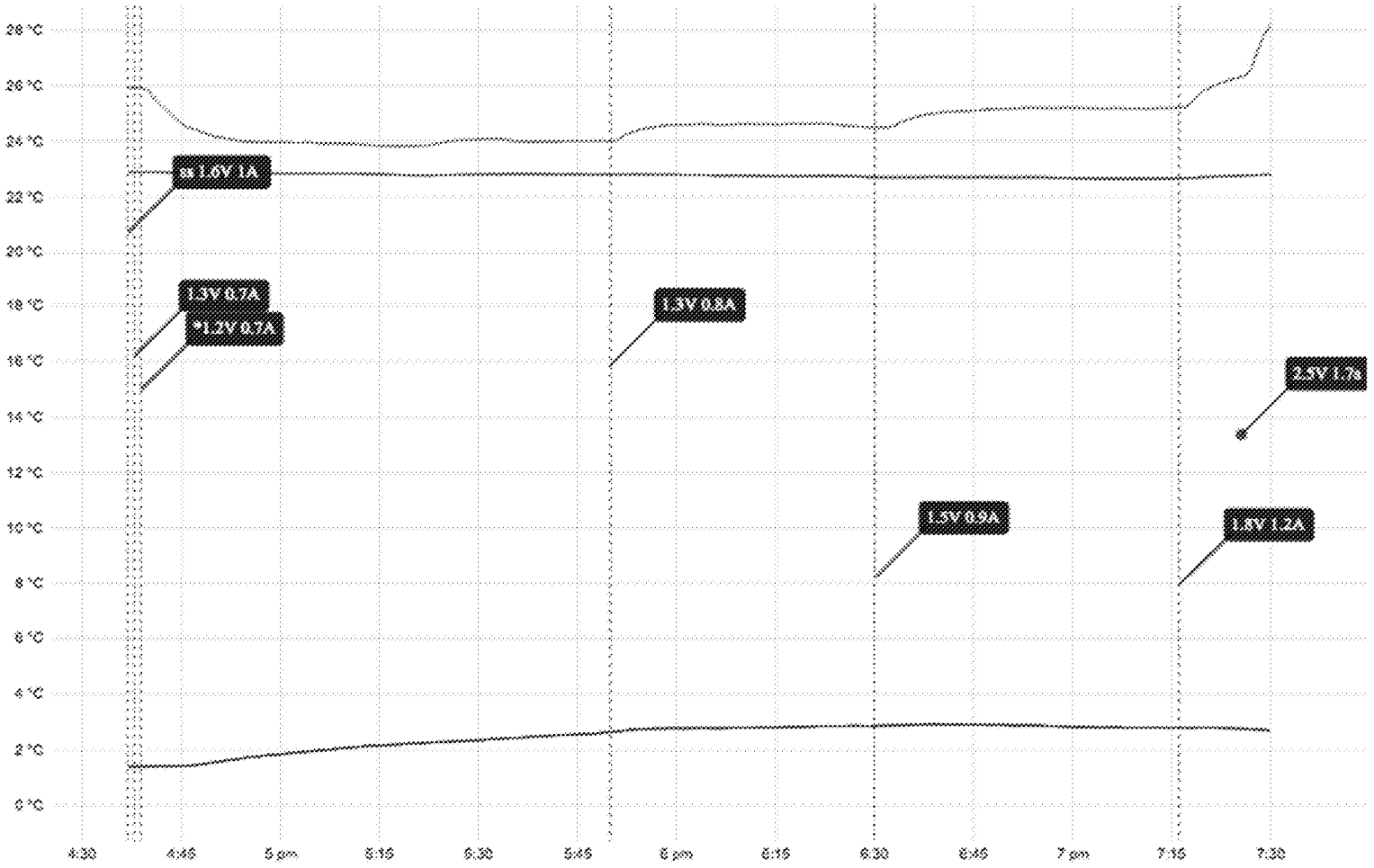
FIG. 12 is a graph depicting the thermal performance of a refrigerated container for a steady state test.

Referring now to FIG. 12, shown therein are test results for a steady state test. This test allows one to determine how much power is needed to maintain the low-end temperature in the container 100. Several voltages were tested to attempt to characterize the performance of the device and correlate the power input to the steady state difference in temperature between the contents of the container and the environment. This relationship can be used to predict the operating envelope in terms of battery life, maximum temperature difference between the inside and outside the container 100, as well as offer insight into a feasible pattern of time operating in a coupled and decoupled configuration The prototype for this testing included a 3D printed lid with a crude decoupling mechanism, and a 1.2 W fan was attached to the heat sink. There was 405 mL of water and a copper cylinder that were on the cold side heat sink. Power was provided by an external DC power supply/voltage controller. The Peltier coolers were two thermoelectric elements (e.g., TE-35-0.6-1.0p) that were arranged to be thermally parallel with one another.

Figure 13:
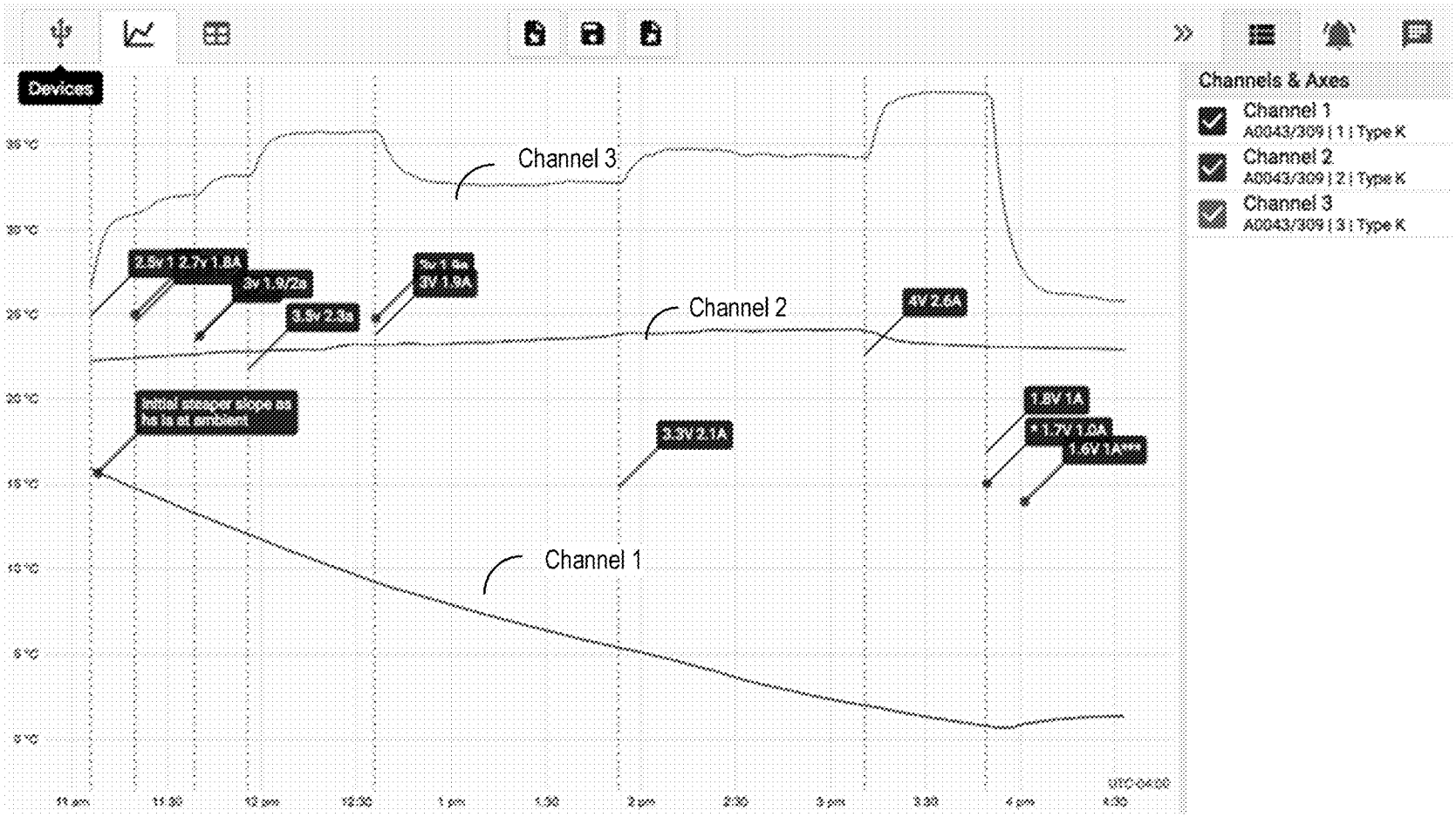
FIG. 13 is a graph depicting the thermal performance of a refrigerated container for a cooldown test.

Referring now to FIG. 13, shown therein are test results for a cooldown test. During this test, the voltage across the thermoelectric cell was varied throughout the cooldown period to determine steady state heat sink temperatures at each voltage as well as determine the heat removal rate at differing voltages. The prototype used for this experiment was the same as that described for the experimental results of FIG. 12.

Figure 14:
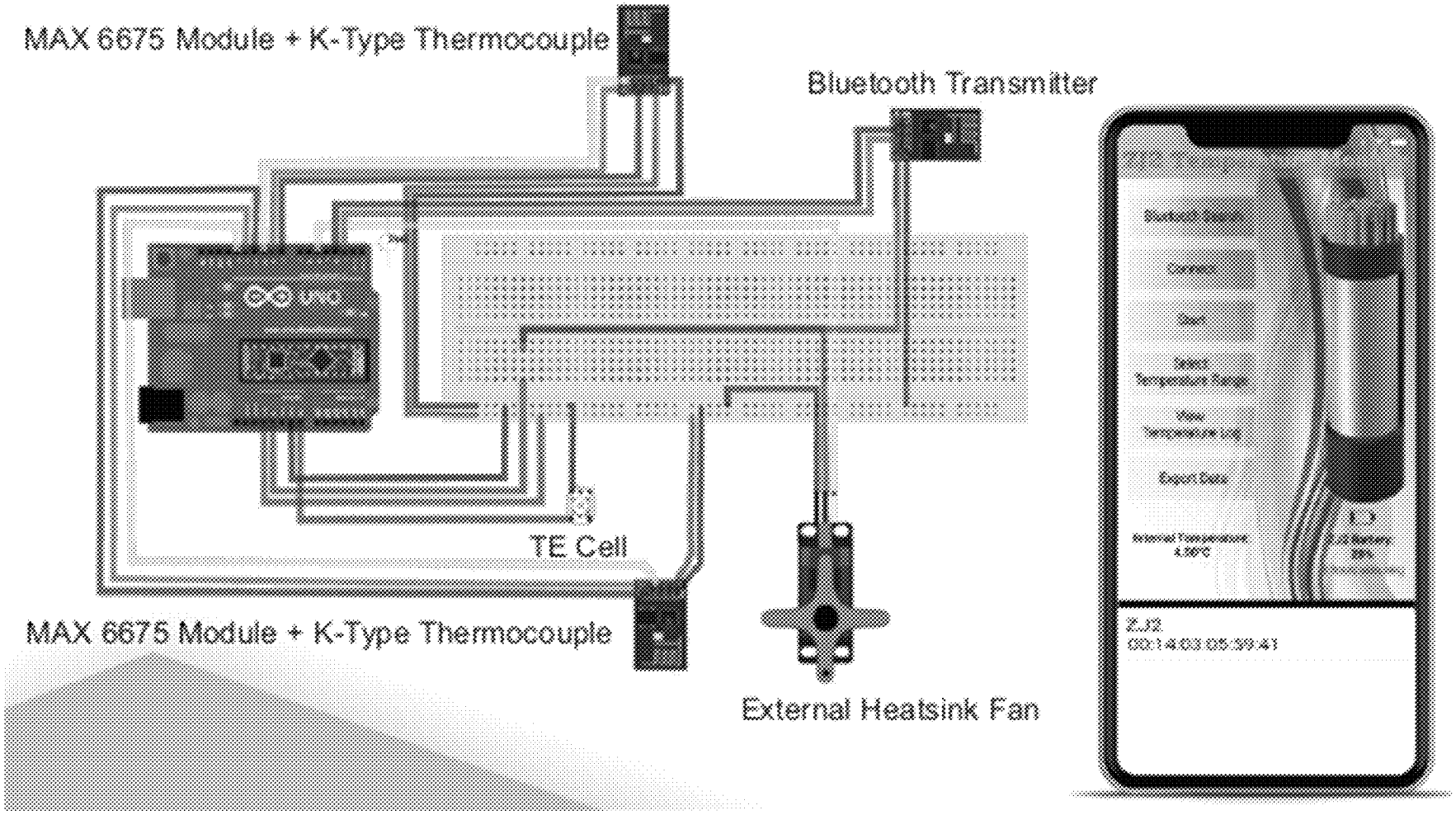
FIG. 14 shows an example of a benchtop controller setup with a corresponding software application.

Referring now to FIG. 14, shown therein is an example of a benchtop controller setup with a corresponding software application. In this example embodiment, an Arduino controller is used, which connects to the operator's smartphone, or another mobile device, through a Bluetooth communication chip. The controller may be configured to log the measured temperature of the interior of the container 100 and display the measured temperatures via an application on the smartphone. The controller can adjust the thermoelectric cell input voltage based on the internal temperature measured. Graphs can be generated by the controller that show the last 24 hours of measured temperatures. The controller may be configured to provide timers and/or alerts which are prompted when the measured temperature moves outside of a desired temperature range and when the container should be moved to the decoupled configuration.

Figure 15:
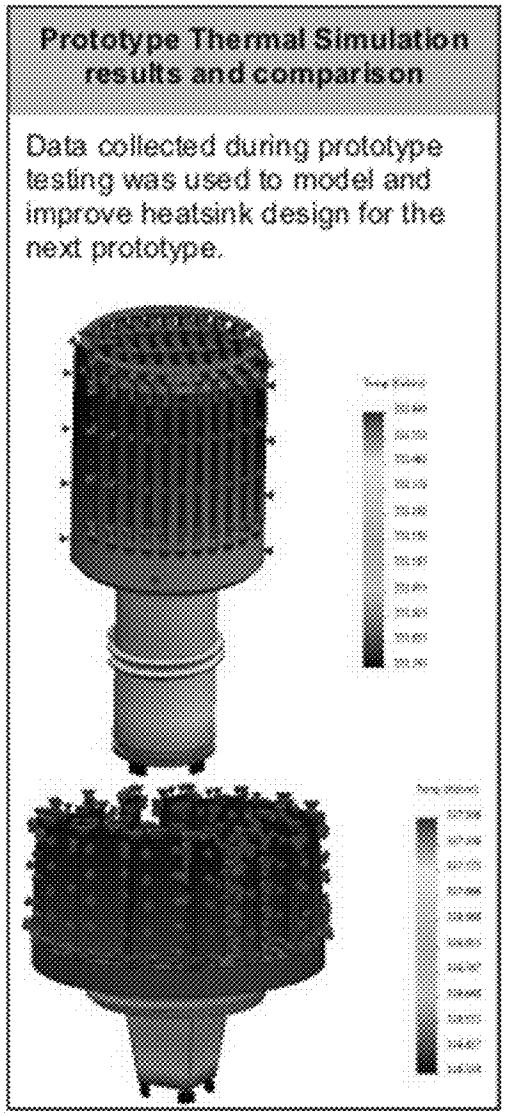
FIG. 15 shows thermal simulation results and comparison for two different heatsinks.

Referring now to FIG. 15, shown therein are thermal simulation results and comparison for two different heatsinks. Data collected during prototype testing can be used to model and improve the heatsink configuration for future prototypes.

Figure 16A:
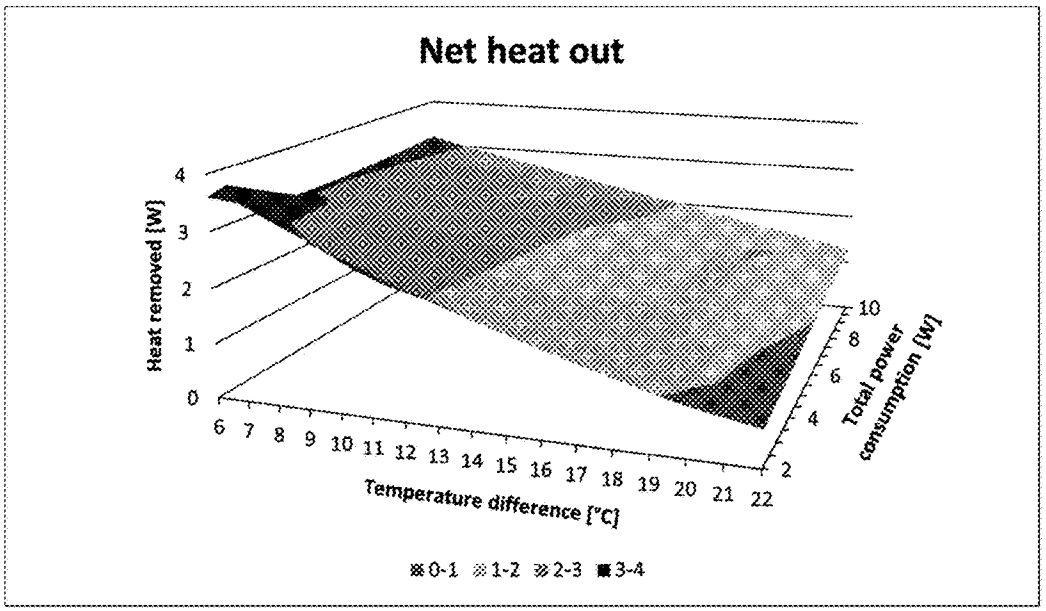
FIG. 16A shows performance of a prototype refrigerated container in terms of net heat out determined by measuring heat removed versus temperature difference and power.

Referring now to FIG. 16A, shown therein is performance data for a prototype refrigerated container in terms of net heat out determined by measuring heat removed versus temperature difference and power. The prototype used for this experiment was the same as that described for the experimental results of FIG. 12. The power [W] refers to the total power consumption of the device including the 1.2 W fan. The temperature difference refers to the difference between the contents of the container and the ambient temperature. Heat removed refers to the net heat out.

Figure 16B:
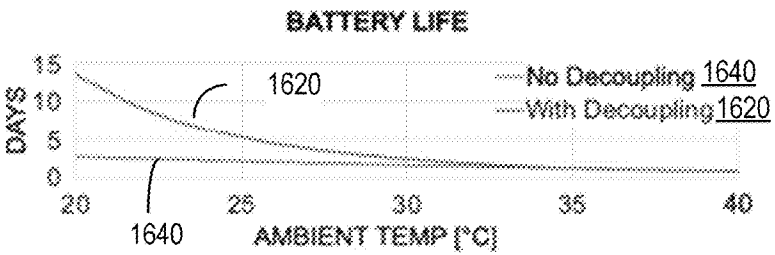
FIG. 16B shows performance of a simulation of a refrigerated container in terms of number of days of battery life versus the ambient temperature when a prototype refrigerated container is in a decoupled configuration and in a coupled configuration.

Referring now to FIG. 16B, shown therein is a projection for performance data (based on experimental data) in terms of number of days of battery life versus the ambient temperature for a prototype refrigerated container that alternates between coupled and decoupled operation 1620 and a prototype refrigerated container that does not have the ability to decouple 1640. The prototype used for this experiment was the same as that described for the experimental results of FIG. 12.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

The invention claimed is:

1. A container having a coupled and decoupled configuration for maintaining a target temperature within the container, wherein the container comprises:

an insulated body;

a lid that is releasably couplable to an upper portion of the insulated body;

an exterior heatsink, coupled to the lid, the exterior heatsink having an exterior heatsink interface;

an interior heatsink, positionable within the insulated body, the interior heatsink having an interior heatsink interface; and at least one thermoelectric cell;

wherein in the coupled configuration, the exterior heatsink interface and the interior heatsink interface are engaged such that heat is conducted from the interior heatsink interface to the exterior heatsink interface or from the exterior heatsink interface to the interior heatsink interface; and wherein in the decoupled configuration, the exterior heatsink interface and/or the interior heatsink interface are separated by a vacuum volume to reduce any heat transfer between the interior heatsink interface and the exterior heatsink interface, the vacuum volume containing a vacuum that is created by movement of the exterior heatsink and/or the interior heatsink.

2. The container of claim 1, wherein the interior heatsink further comprises a carriage portion, wherein the carriage portion comprises a plurality of cavities.

3. The container of claim 2, wherein the cavities are shaped to receive at least one vessel including a vial.

4. The container of claim 2, wherein each cavity is filled with a thermal mass fluid.

5. The container of claim 2, wherein the container further comprises a sleeve that is disposed within the insulated body and has a reservoir for receiving a thermal mass fluid.

6. The container of claim 5, wherein the sleeve is disposed around the carriage portion.

7. The container of claim 1, wherein the at least one thermoelectric cell is coupled to the interior heatsink.

8. The container of claim 1, further comprising an energy source, wherein the energy source is coupled to the at least one thermoelectric cell.

9. The container of claim 8, further comprising a temperature sensor and a controller coupled to the energy source and the at least one thermoelectric cell, wherein the controller is configured to adjust energy flow from the energy source to the at least one thermoelectric cell based on an output from the temperature sensor.

10. The container of claim 1, wherein the insulated body is vacuum insulated.

11. The container of claim 1, wherein the container further comprises a fan that is coupled to the exterior heatsink and is operated to transfer additional heat away from the exterior heatsink when heat is being transferred out of the interior of the container to the surrounding environment.

12. The container of claim 1, wherein the container further comprises a radiator that is coupled to the exterior heatsink to promote additional heat transfer from the exterior heatsink to the surrounding environment of the container when heat is transferred out of the interior of the container to the surrounding environment.

13. The container of claim 1, wherein the container further comprises a decoupling mechanism for decoupling the exterior heatsink interface from the interior heatsink interface, wherein the decoupling mechanism is manual or automatic.

14. A method of transporting at least one vessel using a container defined according to claim 1, wherein the method comprises:

placing the at least one vessel within the insulated body;

coupling the lid to the insulated body; and activating the at least one thermoelectric cell, such that the at least one thermoelectric cell transfers heat from the inside of the container to the outside of the container or transfers heat from outside of the container to within the insulated body; or deactivating the at least one thermoelectric cell by moving a heat sink relative to the at least one thermoelectric cell to separate the heat sink from the at least one thermoelectric cell by a vacuum volume containing a vacuum that is created by movement of the heat sink.

15. The method of claim 14, wherein the at least one vessel is a medical vial that includes a pharmaceutical composition.

16. The method of claim 15, wherein the method further comprises pouring a thermal mass fluid into cavities inside the insulated body.

17. The method of claim 15, wherein the method further comprises filling a sleeve that is disposed within the insulated body with a thermal mass fluid.

18. The method of claim 14, wherein, when the container reaches a predetermined cooling temperature, the method further comprises the deactivating of the at least one thermoelectric cell and moving the lid to a decoupled configuration to prevent heat ingress into the container.

* * * * *